US007086582B2

(12) United States Patent
Yang et al.

(10) Patent No.: US 7,086,582 B2
(45) Date of Patent: Aug. 8, 2006

(54) SEQUENTIAL PUNCH PRESS WITH COMPLEMENTARY SLIDING PLATES

(75) Inventors: Chia Hsiang Yang, Tu-chen (TW); Chun-Hsien Chiang, Tu-Chen (TW); Zai Xing Wu, Shenzhen (CN); Liu Sheng Tang, Shenzhen (CN); You Cai Yang, Shenzhen (CN); Ke Liu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 413 days.

(21) Appl. No.: 10/142,469

(22) Filed: May 9, 2002

(65) Prior Publication Data

US 2003/0177878 A1 Sep. 25, 2003

(30) Foreign Application Priority Data

Mar. 20, 2002 (CN) ..... 91105259 A

(51) Int. Cl.
*B26F 1/04* (2006.01)
*B26F 1/14* (2006.01)

(52) U.S. Cl. ..... 234/109; 234/114; 83/549; 83/563; 83/684; 83/687

(58) Field of Classification Search ..... 234/104–117; 83/549, 682, 684, 685, 686, 687, 563, 571, 83/573, 698.91
See application file for complete search history.

(56) References Cited

U.S. PATENT DOCUMENTS 1,689,995 A * 10/1928 Davis ..... 234/117
2,185,685 A * 1/1940 Blakely ..... 234/94
2,397,605 A * 4/1946 Holden ..... 234/110
2,622,682 A * 12/1952 Kopczynski ..... 83/698.91
2,984,137 A * 5/1961 Wilson ..... 83/549
3,022,000 A * 2/1962 Millis ..... 234/114
3,311,297 A * 3/1967 Williamson et al. ..... 234/114
3,334,809 A * 8/1967 Zajic et al. ..... 234/106
3,394,881 A * 7/1968 Gyi ..... 234/102
3,733,466 A * 5/1973 Krumrey ..... 234/98
4,091,700 A * 5/1978 Cloup ..... 83/549
4,138,197 A * 2/1979 Minton ..... 234/115
4,228,709 A * 10/1980 Guzay et al. ..... 83/622
4,480,782 A * 11/1984 Morishima ..... 234/98
4,569,267 A * 2/1986 Klingel ..... 234/111
4,596,359 A * 6/1986 Nordli ..... 234/115
4,623,089 A * 11/1986 Scott ..... 234/114
4,685,613 A * 8/1987 Schambre ..... 234/115

(Continued)

*Primary Examiner*—Timothy V. Eley
*Assistant Examiner*—Jason Prone
(74) *Attorney, Agent, or Firm*—Wei Te Chung

(57) ABSTRACT

A sequential punch press includes an upper die (10), a lower die (90), and an adjusting device (60) in the upper die. The upper die sequentially includes a punch set (20), a punch pad (30), a punch holder (40), and a stripper (50). A punch (70) is vertically and movably secured in the punch holder and received in the stripper. The adjusting device includes first and second sliding plates (64, 66) respectively having protrusions (65*b*, 67*b*), a piston cylinder (68) having a piston rod (682) fixedly connected with the first sliding plate, and a programmable controller for causing the piston rod to slidingly move the first sliding plate. When the first protrusions opposingly abut the second protrusions, the punch can extend beyond the stripper to punch a workpiece. When the first protrusions do not opposingly abut the second protrusions, the punch cannot extend beyond the stripper to punch the workpiece.

7 Claims, 3 Drawing Sheets

U.S. PATENT DOCUMENTS 4,898,056 A * 2/1990 Grobb et al. ..... 83/691
5,044,242 A * 9/1991 Chiang ..... 83/549
5,144,872 A * 9/1992 Kakimoto ..... 234/114
5,195,413 A * 3/1993 Johnson ..... 83/132
5,881,625 A * 3/1999 Wellman ..... 234/114
6,223,636 B1 * 5/2001 LaPlante et al. ..... 83/549
6,565,496 B1 * 5/2003 LaPlante et al. ..... 83/549
6,622,908 B1 * 9/2003 Fukumoto et al. ..... 83/549
6,769,600 B1 * 8/2004 Knox et al. ..... 83/549

* cited by examiner

SEQUENTIAL PUNCH PRESS WITH COMPLEMENTARY SLIDING PLATES

BACKGROUND OF THE INVENTION

1. Field of the Invention

The present invention relates to sequential punch presses, and particularly to a sequential punch press with a punch which can selectively punch a workpiece.

2. Description of Related Art

Various electronic devices are ubiquitous in modem society. For example, computer servers and routers pervade the business world. Enclosures of such electronic devices are usually formed by processes including punching.

Conventional means for forming enclosures from a workpiece comprise, for example, laser machining and conventional sequential punch machining. However, laser machining is costly and is therefore not widely used. Conventional sequential punch machining involves a series of stages of machining the workpiece. The workpiece is sequentially moved a same fixed distance at each stage of machining. This provides convenient machining when the workpiece is required to be machined at regular fixed intervals. However, it is problematic when the workpiece is required to be machined at irregular intervals. In such case, the conventional sequential punch press must be configured with suitable punches such that the punches simultaneously punch the workpiece in a single stroke. Thereupon, the entire workpiece is moved out from the punch press. Machining of the entire workpiece is completed within a single stage. The entire length of the workpiece must be moved out of the punch press in a single stage. Thus when the workpiece is very long, commonly 2 or 3 meters, the punch press must be equipped with a long lower plate to be able to perform the single-stage punching of the entire workpiece. All these requirements are inconvenient and time-consuming.

SUMMARY OF THE INVENTION

Accordingly, an object of the present invention is to provide a sequential punch press which can readily and efficiently machine long workpieces.

In order to achieve the above-mentioned object, a sequential punch press in accordance with the present invention includes an upper die and a lower die. The upper die sequentially includes a punch set, a punch pad, a punch holder, and a stripper. The punch set, punch pad, and punch holder are fixedly secured together. The stripper is movably secured under the punch holder. A punch is vertically and movably secured in the punch holder and received in the stripper. The upper die further includes an adjusting device. The adjusting device includes a first sliding plate having first protrusions, a second sliding plate having second protrusions, and a piston cylinder having a piston rod fixedly connected with the first sliding plate. The adjusting device further includes a programmable controller for causing the piston rod to slidingly move the first sliding plate, thereby adjusting relative positions of the first protrusions and the second protrusions. When the first protrusions opposingly abut the second protrusions the punch can extend beyond the stripper to punch a workpiece in operation. When the first protrusions do not opposingly abut the second protrusions, the punch cannot extend beyond the stripper to punch the workpiece in operation.

Other objects, advantages and novel features of the invention will become more apparent from the following detailed description when taken in conjunction with the accompanying drawings.

DETAILED DESCRIPTION OF THE PREFERRED EMBODIMENT

Figure 1:
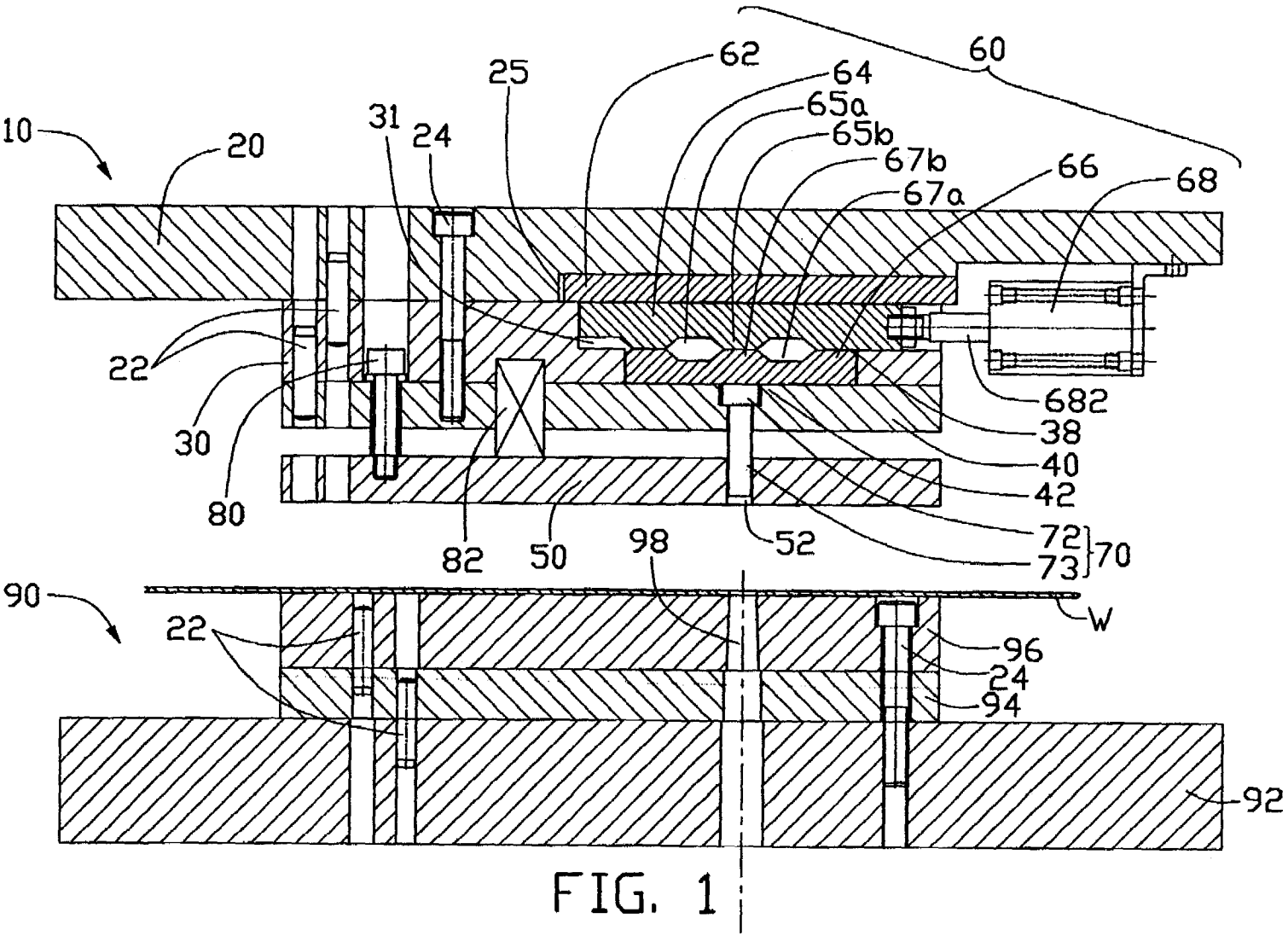
FIG. 1 is a schematic cross-sectional side view of a sequential punch press in accordance with the present invention, together with a workpiece placed therein ready for punching.

Referring to FIG. 1, a sequential punch press for sequentially punching a workpiece W in accordance with the present invention comprises an upper die 10 and a lower die 90. The upper die 10 sequentially comprises, from top to bottom, a punch set 20, a punch pad 30, a punch holder 40 and a stripper 50. The punch set 20, punch pad 30, and punch holder 40 are fixedly secured together by pins 22 and bolts 24. The stripper 50 is movably secured under the punch holder 40 by a fastener 80 that movably extends through the punch holder 40 to engage with the stripper 50. In the preferred embodiment, the fastener 80 is a screw 80. A spring 82 extends through the punch holder 40. One end of the spring 82 is received in the punch pad 30, and an opposite end of the spring 82 is fixed on the stripper 50. The punch holder 40 defines a first cutout 42 in a top wall thereof. The stripper 50 defines a through hole 52 therein. A punch 70 is vertically and movably secured in the punch holder 40. The punch 70 comprises a head 72 received in the first cutout 42 of the punch holder 40, and a machining section 73 depending from the head 72 and extendably received in the through hole 52 of the stripper 50. A bottom end of the machining section 73 is located entirely within the through hole 52. A second cutout 25 is defined in a bottom wall of the punch set 20. A first cavity 31 is defined in a top wall of the punch pad 30, and communicates with the second cutout 25. A second cavity 38 is defined in a bottom wall of the punch pad 30, in communication with the first cavity 31. A size of the second cavity 38 is less than a size of the first cavity 31. A shoulder (not labeled) is therefore formed in the punch pad 30 at a junction of the first cavity 31 and the second cavity 38.

The upper die 10 further comprises an adjusting device 60. The adjusting device 60 comprises a wearable cushion 62, a first sliding plate 64, a second sliding plate 66, a piston cylinder 68, and a programmable controller (not shown). The wearable cushion 62 is secured in the second cutout 25 of the punch set 20. The first sliding plate 64 is movably received in the first cavity 31 of the punch pad 30. A plurality of first indentations 65*a* is defined in a bottom wall of the first sliding plate 64. A plurality of first protrusions 65*b* is thereby formed on the first sliding plate 64, each first protrusion 65*b* separating two adjacent first indentations 65*a*. The second sliding plate 66 is movably received in the second cavity 38 of the punch pad 30. A plurality of second indentations 67*a* is defined in a top wall of the second sliding plate 66. A plurality of second protrusions 67*b* is thereby formed on the second sliding plate 66, each second protrusion 67*b* separating two adjacent second indentations 67*a*. The piston cylinder 68 is installed below the punch set 20. The piston cylinder 68 comprises a piston rod 682 extendable in a horizontal direction. A distal end of the piston rod 682 is fixedly connected with one end of the first sliding plate 64. The first sliding plate 64 is thus slidingly movable in the first cavity 31 in horizontal directions. Accordingly, the second sliding plate 66 is slidingly movable in the second cavity 38 in vertical directions. The programmable controller is connected to the piston cylinder 68, to change a position of the piston rod 682 according to a position of the workpiece W.

The lower die 90 is for cooperating with the upper die 10 to punch the workpiece W. The lower die 90 sequentially comprises, from bottom to top, a die set 92, a die pad 94 and a lower plate 96. The die set 92, die pad 94 and lower plate 96 are fixedly secured together by pins 22 and bolts 24. A tapered hole 98 is defined through the lower plate 96, for extension of the punch 70 thereinto.

In practice, the workpiece W is typically longer than it is wider. For the purposes of conveniently describing the preferred embodiment, it will be assumed hereafter that a plurality of apertures (not shown) is required to be punched in the workpiece W. The apertures are to be arranged in a line along a longitudinal direction of the workpiece W. A distance between any two adjacent apertures of a single workpiece W is equal to or an integral multiple of a predetermined horizontal distance by which the workpiece W is moved each time during operation of the punch press.

Figure 2:
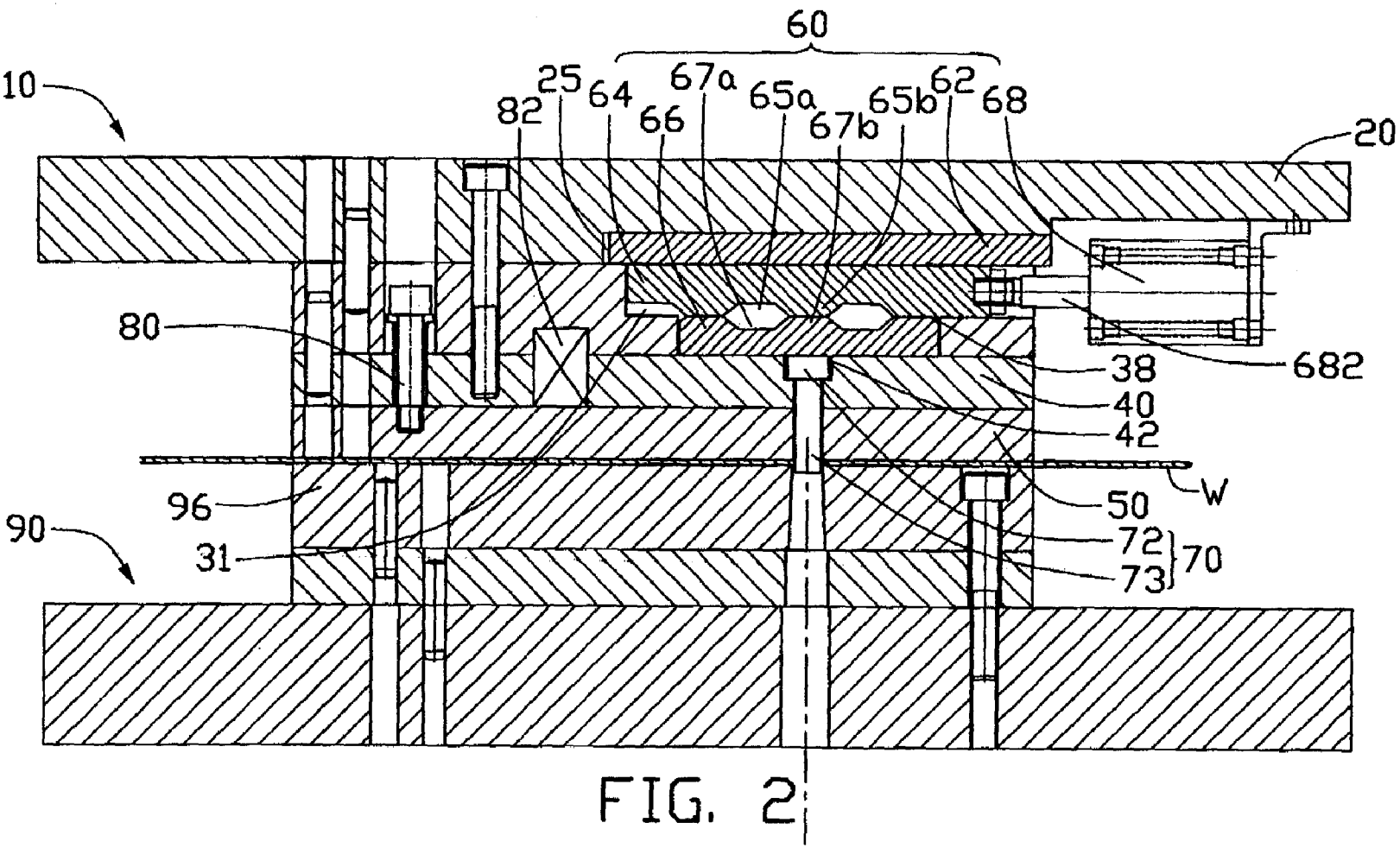
FIG. 2 is similar to FIG. 1, but showing a punch of the sequential punch press punching the workpiece in operation.
Figure 3:
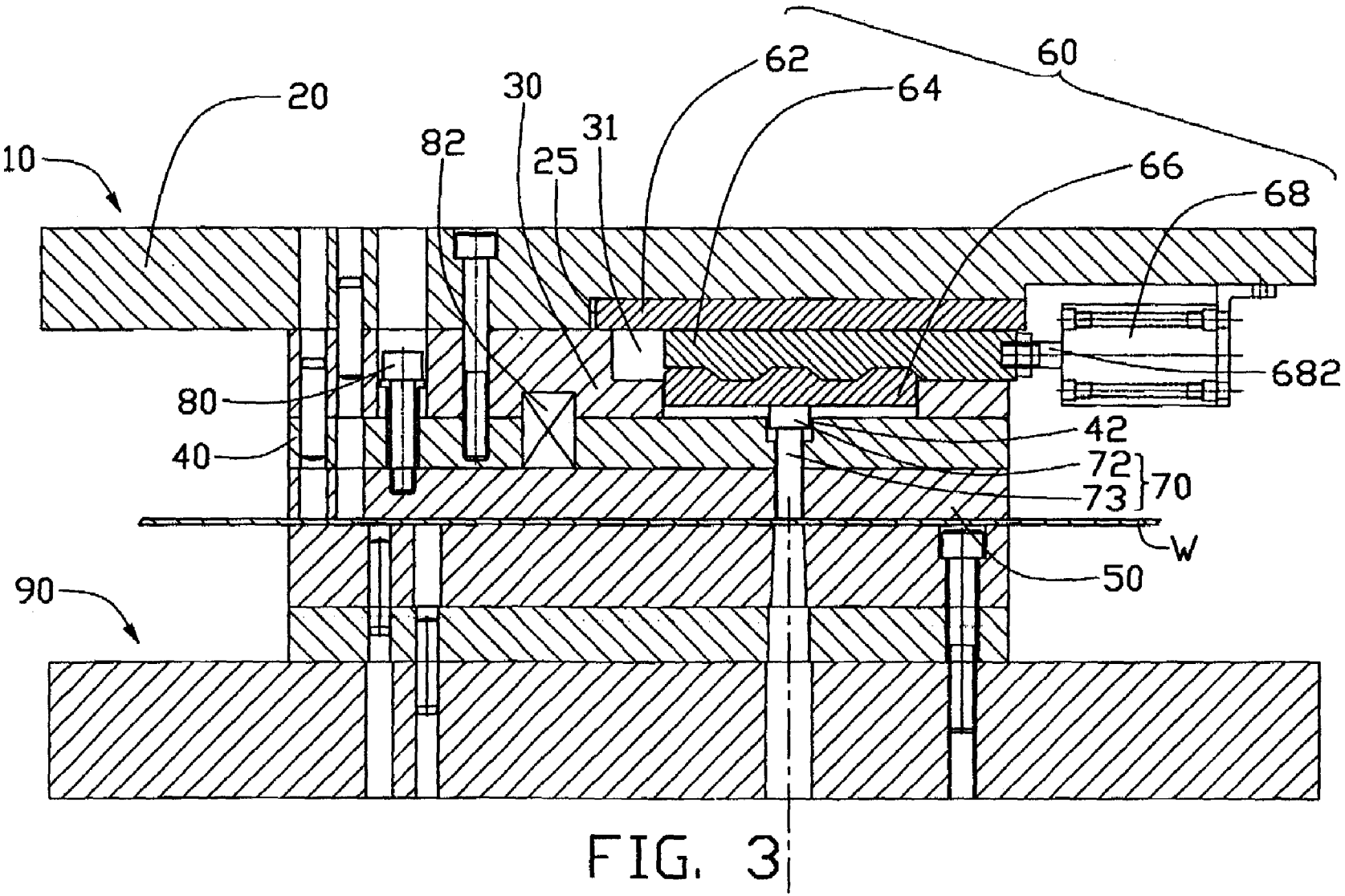
FIG. 3 is similar to FIG. 2, but showing the punch not punching the workpiece in operation.

Referring also to FIGS. 2 and 3, in operation, the workpiece W is placed on the lower plate 96. The piston rod 682 is located in an extendable position. The first protrusions 65*b* of the first sliding plate 64 opposingly abut the second protrusions 67*b* of the second sliding plate 66, respectively. The first indentations 65*a* are in alignment with the second indentations 67*a*, respectively. The head 72 of the punch 70 is fully received in the first cutout 42 of the punch holder 40. In this position, the punch 70 is defined to be in an operational state. The upper die 10 is then moved downwardly toward the lower die 90. The stripper 50 is thus moved downwardly until it contacts the workpiece W. The upper die 10 is continued to be moved downwardly. The punch set 20, punch pad 30 and punch holder 40 are thus moved downwardly relative to the stripper 50. The screw 80 is moved upwardly relative to the punch holder 40, and the spring 82 is compressed. The punch 70 protrudes below the stripper 50, and the machining section 73 of the punch 70 punches one aperture in the workpiece W. The upper die 10 is then moved back upwardly. The spring 82 elastically returns back to its original state, thereby causing the stripper 50 to move away from the punch holder 40. The machining section 73 of the punch 70 returns to its original position entirely within the through hole 52 of the stripper 50.

The workpiece W is then moved horizontally the predetermined distance. At this stage, if another aperture is required to be punched in the workpiece W by the punch 70, the aperture can be punched by movements of the upper die 10 similar to those described above. If no aperture is required to be punched in the workpiece W by the punch 70, the piston rod 682 is retracted to a refracted position via the programmable controller actuating the piston cylinder 68. The first sliding plate 64 is thus moved toward the piston cylinder 68. The first protrusions 65*b* are moved away from the corresponding second protrusions 67*b* until the first protrusions 65*b* oppose the second indentations 67*a*, and the first indentations 65*a* oppose the second protrusions 67*b*. In this position, the punch 70 is defined to be in a non-operational state. The upper die 10 is then moved toward the lower die 90 as described above. When the stripper 50 contacts the workpiece W, the punch 70 is pushed upwardly by the workpiece W. The second sliding plate 66 is pushed upwardly by the punch 70. The second protrusions 67*b* are received in the corresponding first indentations 65*a*, and the first protrusions 65*b* are received in the corresponding second indentations 67*a*. Thus, no aperture is punched in the workpiece W.

In the sequential punch press of the present invention, the position of the first sliding plate 64 can be adjusted relative to the position of the second sliding plate 66 such that the punch 70 either punches or does not punch the workpiece W when the upper die 10 is moved toward the lower die 90. A long workpiece W can thus be easily and conveniently punched, with the workpiece W being moved at relatively short, simple stepwise regular stages.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A punch press for sequentially punching holes in a workpiece, comprising:

an upper die comprising a punch set, a punch holder located below the punch set, a punch movably received in the punch holder, a punch pad arranged between the punch set and the punch holder, a stripper movably secured below the punch holder, and adjusting means for adjusting the upper die so that the punch is selectively in an operational state or in a non-operational state, the punch being extendable through the stripper, the punch pad defining a first cavity in a top thereof, and a second cavity in a bottom thereof in communication with the first cavity; and a lower die cooperating with the upper die to machine the workpiece, wherein when the upper die is moved to the lower die and the punch is in the operational state, the punch can punch the workpiece, and when the upper die is moved to the lower die and the punch is in the non-operational state, the punch cannot punch the workpiece;

the adjusting means comprises a first plate movably received in the first cavity and comprising at least one first protrusion, and a second plate movably received in the second cavity and arranged below the first plate, the second plate comprising at least one second protrusion; and when the at least one first protrusion opposingly abuts the at least one second protrusion, the punch is in the operational state; when the at least one first protrusion does not opposingly abut the at least one second protrusion, the punch is in the non-operational state.

2. The punch press as claimed in claim 1, wherein the adjusting means further comprises a cylinder having a piston rod connecting with the first plate, and wherein the piston is actuated to move the first plate from a position where the at least one first protrusion opposingly abuts the at least one second protrusion to a position where the at least one first protrusion does not opposingly abut the at least one second protrusion.

3. The punch press as claimed in claim 1, wherein the punch and the second plate are movable in a same direction.

4. The punch press as claimed in claim 1, wherein a spring extends through the punch holder, one end of the spring is received in the punch pad, and an opposite end of the spring abuts the stripper.

5. The punch press as claimed in claim 1, wherein a fastener movably extends through he punch holder and is engaged with the stripper.

6. A punch press for sequentially punching a workpiece, the punch press comprising;

an upper die sequentially comprising a punch set, a punch pad, a punch holder, and a stripper, a first plate movably received in the punch pad and having at least one first protrusion, a second plate movably received in the punch pad and having at least one second protrusion, a punch being movably received in the punch holder and the stripper;

adjusting means for adjusting a position of the at least one first protrusion and the at least one second protrusion relative to each other; and a lower die for supporting the workpiece thereon; wherein when the at least one first protrusion opposingly abuts the at least one second protrusion, the punch can extend beyond the stripper to punch the workpiece, and when the at least one first protrusion does not opposingly abut the at least one second protrusion, the punch cannot extend beyond the stripper to punch the workpiece.

7. The punch press as claimed in claim 6, wherein the adjusting means comprises a cylinder having a piston rod connecting with the first plate, the piston rod is actuated to move the first plate from a position where the at least one first protrusion opposingly abuts the at least one second protrusion to a position where the at least one first protrusion does not opposingly abut the at least one second protrusion.

* * * * *